US006679972B1

(12) United States Patent
Tigerström

(10) Patent No.: US 6,679,972 B1
(45) Date of Patent: Jan. 20, 2004

(54) PROCESS FOR THE BLEACHING OF A PULP SUSPENSION BY SEPARATING CALCIUM FROM LIGNIN

(75) Inventor: Anna Tigerström, Stockholm (SE)

(73) Assignee: AGA Aktiebolag, Lidingo (SE)

( * ) Notice: Subject to any disclaimer, the term of this patent is extended or adjusted under 35 U.S.C. 154(b) by 0 days.

(21) Appl. No.: 09/979,913

(22) PCT Filed: May 18, 2000

(86) PCT No.: PCT/EP00/04610

§ 371 (c)(1),
(2), (4) Date: Feb. 15, 2002

(87) PCT Pub. No.: WO00/73576

PCT Pub. Date: Dec. 7, 2000

(30) Foreign Application Priority Data

Jun. 1, 1999 (FI) ..... 991241

(51) Int. Cl.[7] ..... D21C 9/10; D21C 9/14; D21C 9/147; D21C 9/16

(52) U.S. Cl. ..... 162/63; 162/65; 162/76; 162/78; 162/88; 162/89; 162/90

(58) Field of Search ..... 162/65, 63, 70, 162/90, 87, 88, 89, 67, 78, 76, 66, 181.2, 55, 57, 24, 25, 26, 28, 190

(56) References Cited

U.S. PATENT DOCUMENTS

| | | | | |
|---|---|---|---|---|
| 4,016,029 A | | 4/1977 | Samuelson | 162/65 |
| 4,804,440 A | * | 2/1989 | Liebergott et al. | 162/70 |
| 5,139,613 A | * | 8/1992 | Lachapelle | 162/60 |
| 5,378,322 A | | 1/1995 | Hornsey | |

FOREIGN PATENT DOCUMENTS

| | | |
|---|---|---|
| EP | 0 281 273 | 9/1988 |
| EP | 0 296 198 | 9/1991 |
| EP | 0 884 416 | 12/1998 |
| EP | 0 899 374 | 3/1999 |
| GB | 815247 | 6/1959 |
| WO | 88/04705 | 6/1988 |
| WO | 90/09483 | 8/1990 |
| WO | 97/30208 | 8/1997 |
| WO | 99/00545 | 1/1999 |
| WO | 99/24661 | 5/1999 |
| WO | 99/35333 | 7/1999 |

OTHER PUBLICATIONS

Ostberg et al., "Use of Carbon Dioxide in the Production of Sulphate Pulp", 5th International Conference on New Available Technique, The World Pulp and Paper Week, Jun. 4–7, 1996, Stockholm pp. 508–515.

Jonas Sundin et al., "Precipitation of Lignin During Pulp Washing", 1998 Pulping Conference, TAPPI Proceedings, pp. 219–227.

Catrin Gustavsson et al, "The Influence of Cooking Conditions on the Bleachability and Chemical Structure of Kraft Pulps", Nordic Pulp and Paper Research Journal Vol 14, No. Jan. 1999, pp. 71–81.

Nils Hartler, "Sorption Cooking: Yield Increase for Unbleached Alkaline Pulps Through Sorption of Organic Substance from the Black Liquor", Svensk Papperstidning nr 14 1978, pp. 457–463.

* cited by examiner

*Primary Examiner*—Steve Alvo
(74) *Attorney, Agent, or Firm*—Pearne & Gordon LLP

(57) ABSTRACT

A process for the bleaching of lignin present in pulp fibers in an aqueous environment such as a pulp suspension. The invention also relates to a process for producing paper or board from pulp containing bleached lignin. According to the invention carbon dioxide is used for the bleaching of lignin.

24 Claims, No Drawings

PROCESS FOR THE BLEACHING OF A PULP SUSPENSION BY SEPARATING CALCIUM FROM LIGNIN

This application claims the benefit of International Application Number PCT/EP00/04610, which was published in English on Dec. 7, 2000.

The present invention relates to the bleaching of lignin present in pulp fibers in an aqueous environment such as a pulp suspension. The invention also relates to a process for producing paper or board from pulp containing such bleached lignin.

Lignin is an amorphous polymer which, like a glue, keeps the cellulose fibers together in wood. Some lignin also exist in the fiber wall. In its native state in wood lignin is of light color.

The purpose of chemical pulping, such as kraft pulping, is to dissolve the lignin from the wood matrix with a cooking liquor. During cooking lignin is broken down into smaller units and becomes darker, i.e. increases the light absorption. The dark lignin components, some of which are dissolved and some of which are still in the fiber, give the pulp a dark colour.

In the production of paper or board a large proportion of the lignin is washed off the fibers in one or more washing steps. According to EP 296198 (AGA Aktiebolag) the washing-out of substances which contribute to the chemical oxygen demand (COD) in an alkaline cellulosic pulp is improved if the pH of the wash water is lowered with an acid such as carbon dioxide. According to an article by Östberg, G., 5th International Conference of New Available Technique, The World Pulp and Paper Week, Jun. 4–7, 1996, Stockholm pp. 508–515, the said improved washing results in an increased degree of delignification and a consequent decrease in the consumption of bleaching chemicals. Calcium carbonate is formed in a reaction between calcium and the carbonate ions generated by the carbon dioxide. No increase of calcium carbonate deposition on the equipment was observed.

Sundin, J. et al. in "Precipitation of lignin during pulp washing", p. 219–227, proceedings, TAPPI Pulping Conference, 1998, discloses that the addition of calcium or magnesium ions to deionized water used for washing a pulp provided washed pulps with a higher kappa number (a common measure of the lignin content) than pulps washed without addition of these ions. There was found to be a correlation between kappa number and the concentration of calcium, magnesium and the like ions in the wash water. The more ions were added, the higher the kappa number.

Sundin et al. also showed that lignin which precipitated during washing with water to which calcium ions had been added was darker than the other residual lignin in the pulp. Pulps washed with water containing calcium ions were significantly darker than those without such ions.

In a recent publication Gustavsson, C. et al. Nordic Pulp and Paper Research Journal Vol 14, No 1, 1999, p 71–81, noted a distinct decrease in the content of calcium when cooking with a high hydroxide ion concentration. An explanation to the phenomenon is said to be that the calcium is bound to dissolved lignin fragments at high hydroxide ion concentration and, consequently, there is a decreased precipitation of calcium carbonate on the pulp fibers.

On the other hand, WO 90/09483 (Mo och Donsjö Aktiebolag) utilizes the tendency of calcium carbonate to precipitate at an alkaline pH for reducing the amount of gypsum (calcium sulphate) precipitation in a paper stock. A precipitation of the calcium carbonate is induced by adding (bi)carbonate ions to the system. The ions may be created in situ by an addition of sodium hydroxide and carbon dioxide.

According to WO 99/00545 (Sunds Defibrator Industries AB) the release of calcium ions into the filtrate of a papermaking system by acidic bleaching conditions below pH 7 cause harmful precipitations on the equipment. The calcium ions are absorbed on the pulp by an addition of carbonate ions and removed with the pulp.

According to U.S. Pat. No. 5,139,613 (Canadian Liquid Air Limited) carbon dioxide is used to acidify a pulp slurry after it has been bleached with hypochlorite or hydrogen peroxide. The souring with $CO_2$ instead of $SO_2$ does not destroy the bleaching chemical which allows the residual bleaching chemicals to continue their bleaching effect for a longer time.

According to GB Patent Application 2 008 562 carbon dioxide may be used for increasing the solubility of calcium carbonate and for the hardening of recycled waters used in the treatment of pulp from waste paper.

Carbon dioxide is a gas, which easily dissolves under alkaline conditions, e.g. in water or a pulp suspension forming carbonic acid and bicarbonate and/or carbonate ions according to the reaction:

$$CO_2+H_2O \Leftrightarrow H_2CO_3 \Leftrightarrow H^++HCO_3^- \Leftrightarrow 2H^++CO_3^{2-} \quad (1)$$

Water soluble salts of carbonic acid such as sodium bicarbonate $NaHCO_3$ and sodium carbonate $Na_2CO_3$ also provide bicarbonate and carbonate ions in an aqueous environment.

Carbonate ions have the ability of being bound to calcium ions and of creating calcium carbonate, which is a salt with a low solubility at alkaline pH:

$$CO_3^{2-}+Ca^{2+} \Leftrightarrow CaCO_3(aq) \Leftrightarrow CaCO_3(s) \quad (2)$$

At a pH below about 8 calcium carbonate starts to dissolve and the concentration of free calcium ions increases. High concentrations of free calcium ions in a papermaking system are known to cause complex coagulation and scaling problems in papermaking.

The present invention, as defined in the appended claims, is based on the realization that carbonic acid and salts thereof, which provide carbonate and bicarbonate ions, can be used for bleaching calcium containing lignin dissolved or present in pulp fibers in an aqueous pulp suspension.

Although not wishing to be bound by any theory, it is believed that the (bi)carbonate ions are capable of trapping calcium present in the system and thus reducing the influence of calcium on the lignin. This, in turn, provides lignin compounds in the pulp which are lighter in colour. The bleached lignin compounds may also be easier to remove from the fibers causing the pulp to have a reduced lignin content. In either case, the paper resulting from the (bi) carbonate bleached pulp will have an increased brightness. Thus, such a pulp requires a reduced amount of other bleaching chemicals to provide the desired brightness.

The carbonic acid is preferably provided by dissolving carbon dioxide gas in the aqueous pulp suspension. The dissolved gas will produce carbonic acid in the water and will, in turn, provide carbonate and/or bicarbonate ions in the suspension. Carbon dioxide may also be added in liquid or solid form to the suspension.

The carbonates/bicarbonates in the aqueous environment will associate with calcium ions in said environment in such a way that the calcium ions become "trapped" in calcium carbonate. This will reduce the amount of calcium available to influence the lignin. The result will show up as an increased brightness and possibly also as a lower kappa number in the pulp:

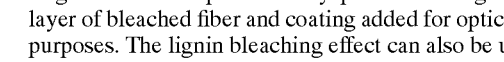

$$Ca^{2+}- - - ligin^{-}+CO_3^{2-} <=> lignin^{-}+CaCO_3 \quad (3)$$

For a high kappa pulp intended to be used in its unbleached form, for example in packaging grades such as linerboard and sack paper, the result of carbon dioxide addition and consequent calcium ion removal from lignin is a brighter pulp/paper with very likely also a lower kappa number at the same cooking conditions. This pulp/paper can be used as such as an unbleached product with higher brightness or the product may provide savings in the top layer of bleached fiber and coating added for optical/printing purposes. The lignin bleaching effect can also be utilized for producing a pulp with the same kappa number as before but with less severe cooking conditions, which means increased productivity, steam savings, increased selectivity or savings in cooking chemicals.

For a pulp intended to be bleached, reducing the influence of calcium ions on lignin makes a pulp with a improved bleachability; consuming less bleaching chemicals to a given brightness.

To reach the desired effect, the carbon dioxide may be added at various positions in the fiber line or the papermachine. It should be observed that the (bi)carbonate ions required in the bleaching process may also be provided by adding carbonic acid or salts of carbonic acid, i.e. (bi) carbonate salts such as sodium bicarbonate or carbonate to the pulp suspension.

The preferred way of providing the carbonate/bicarbonate ions is to add carbon dioxide gas to the aqueous pulp suspension. From a dissolving point of view of the carbon dioxide should preferably be added to an aqueous medium in an alkaline state. Thus, a pH around 8 or above is preferred. On the other hand, the value of inactivating deleterious calcium ions in lignin is highest at a lower pH when less phenolic groups are ionized and the lignin molecules have a higher tendency to precipitate. The pH decreasing effect of the addition of carbon dioxide may be countered by the addition of an alkali such as sodium hydroxide to the solution.

The optimum pH at which to add $CO_2$ depends on the number of groups in the lignin with the capacity to become ionized (normally a function of kappa number, cooking method, wood type), the purity of the cooking chemicals and water purity. As the lignin which is most difficult to remove is left in the pulp to the last bleaching stage and its number of ionized groups is low, $CO_2$ addition before such stage to trap any calcium ions present, can be especially beneficial.

One should avoid adding $CO_2$ when a high amount of the black liquor is present. A publication by Hartler ("Sorption cooking", Svensk Papperstidning, p 457–463, No 14, 1978) describes sorption cooking, a method where $CO_2$ addition increases yield by re-deposition of lignin from the black liquor to the fiber. Using the same chemical ($CO_2$) sorption cooking has quite the opposite effect to the process described in this patent application.

In the case of a high kappa pulp one suitable location to add $CO_2$ is to the outlet of final storage in the pulp mill from where the pulp is transported to storage in the paper mill. $CO_2$ can either be added to the dilution water or directly to the pulp.

The pulp is preferably a chemical pulp. The pulp may or may not be delignified in an oxygen delignification stage. One preferred stage of adding $CO_2$ is before a D-stage bleaching, preferably before a storage tower before such bleaching. The $CO_2$ may also be added to a pulp which is subsequently to be bleached with chlorine dioxide, peroxide, peracetic acid, ozone, chlorine, hypo, or the like bleaching chemical. Another preferred position is before, after or in a wash stage in the fiber line of a pulp mill. Adding bleaching $CO_2$ after a wash stage wherein a large proportion of the lignin has been removed by washing is especially effective.

In a preferred embodiment of the invention the pulp is a chemical pulp which has been washed and carbon dioxide is fed into a stream of pulp between a wash stage and a storage at the end of the fiber line of a pulp mill. The carbon dioxide is preferably fed into a stream of water used to dilute the pulp prior to final storage in the fiber line.

The calcium trapped by said carbon dioxide from said lignin may be removed from said pulp suspension by a press stage or a wash stage preceding storage or the like process.

The pulp to be treated according to the present invention may also be a papermaking stock before, after or in a stock preparation stage of a paper mill. Examples of such stock preparation stages are a dilution stage, a refining stage, a screening stage and a mixing stage.

The carbon dioxide may be introduced into a stream of white water in the long or the short circulation of a papermachine.

The present invention is preferably utilized in the production of paper or board whereby paper or board is produced having an increased brightness and/or a reduced kappa number, compared to paper or board produced without the (bi)carbonate addition, by a process comprising providing a chemical pulp suspension of cellulosic fibers and calcium containing lignin compounds in an aqueous environment, providing carbonic acid or a salt thereof in said suspension or in a stream of water entering said suspension for causing a substantial bleaching of lignin present in said suspension and/or for facilitating the freeing of calcium containing lignin from the fibers in said suspension, processing said suspension into paper or board.

The lignin which is bleached by the present process is generally a calcium-containing lignin and the amount of carbon dioxide or carbonic acid salt added to the suspension should be sufficient to trap a significant amount of the calcium present in the suspension, thus providing a lighter coloured lignin which will also more easily be freed from the fibers.

The following examples illustrate the invention:

EXAMPLE 1

$CO_2$ was added to a high kappa pulp at the outlet from the final storage in a pulp mill from where the pulp was transported to storage in the paper mill. The $CO_2$ was added to the dilution water and the brightness of the final product, the paper, became 2 ISO units brighter.

EXAMPLE 2

In a case of a softwood kraft pulp to be bleached with chlorine dioxide, 3 kg $CO_2$/ton of pulp was added before 30 minutes storage after which the pulp was pumped to the chlorine dioxide bleaching stage. 3 kg $CO_2$/ton of pulp addition resulted in 3 kg $ClO_2$/ton of pulp savings in the bleach plant to reach the same bleach result.

EXAMPLE 3

In a case of kraft pulp to be bleached in a TCF sequence with peroxide 4 kg $CO_2$/ton of pulp was charged to the dilution water of the pulp before the final wash stage before bleaching. In the bleach plant the bleach chemical consumption was reduced with 5 kg $H_2O_2$/ton pulp.

EXAMPLE 4

A laboratory test was performed in a Quantum mixer. A softwood kraft pulp with kappa number 65 was used. The pulp was diluted with de-ionized water to a consistency of 8%. $CO_2$ was added to the pulp in the mixer under slow stirring. The pH was observed during 60 minutes treatment.

Thereafter the pulp was diluted with de-ionized water to a consistency of 1%. The pulp suspension was divided in two samples, where one was adjusted to pH 5 with $H_2SO_4$. Sheets were prepared and the brightness was measured with an Elrepho instrument. The results of the trials is shown in the Table below.

TABLE

| Trial No. | $CO_2$ kg/t | pH after 60 min. | Adjusted pH | Brightness % ISO | Unadjusted pH | Brightness % |
|---|---|---|---|---|---|---|
| 4 | 0 | 8.2 | 5 | 19.8 | | |
| 3 | 0 | 8.2 | | | 9.2 | 18.4 |
| 6 | 3 | 6.8 | 5 | 20.2 | | |
| 5 | 3 | 6.8 | | | 8.5 | 19.3 |
| 8 | 9 | 6 | 5 | 20 | | |
| 7 | 9 | 6 | | | 7.6 | 19.4 |
| 1 | 15 | 6.2 | 5 | 21.6 | | |
| 2 | 15 | 6.2 | | | 7.1 | 20.8 |

The tests clearly show an increased brightness in response to an increased addition of carbon dioxide.

What is claimed is:

1. A process for producing paper or board comprising providing a chemical pulp suspension and cellulosic fibers and calcium containing lignin in an aqueous environment, bleaching said suspension in a bleaching stage, and processing the bleached suspension into paper or board, characterized by providing in said bleaching stage carbonic acid or a salt thereof as the only bleaching chemical provided in said stage, said acid or salt being provided in said suspension or in a stream of water entering said suspension for causing a substantial bleaching by separating calcium from said calcium containing lignin present in said suspension and facilitating the freeing of lignin from the fibers in said suspension, whereby paper or board processed from said suspension will have an increased brightness and/or a reduced kappa number compared to a similar product produced without said carbonic acid or its salt.

2. The process according to claim 1, wherein said carbonic acid is provided by introducing carbon dioxide gas into said suspension or stream.

3. The process according to claim 1 or 2, wherein carbonic acid and/or an alkaline metal salt thereof is introduced in said suspension or stream in an amount sufficient for providing a chemically effective amount of carbonate and/or bicarbonate ions in said suspension for trapping a substantial amount of the calcium and reducing the amount of calcium influencing the lignin.

4. A process for producing paper or board comprising the steps of providing a chemical pulp suspension comprising cellulosic fibers including calcium containing lignin in an aqueous environment, bleaching said suspension in a bleaching stage, and processing the bleached suspension into paper or board, the step of bleaching said pulp suspension including providing in said bleaching stage carbonic acid or a salt thereof, said acid or salt being provided in said suspension or in a stream of water entering said suspension for causing a substantial bleaching by separating calcium from said calcium containing lignin present in said suspension and facilitating the freeing of lignin from the fibers in said suspension, whereby paper or board processed from said suspension will have an increased brightness and/or a reduced kappa number compared to a similar product produced without said carbonic acid or its salt.

5. The method of claim 1 or 4, wherein said step of contacting said fibers with carbonic acid or a salt thereof includes dissolving gaseous carbon dioxide in said aqueous environment to form said carbonic acid, said carbonic acid disassociating in said aqueous environment to form carbonate and/or bicarbonate ions.

6. The method according to claim 5, wherein said carbon dioxide is introduced into a stream of white water in the long or the short circulation of a paper machine.

7. The method of claim 5, further including the step of removing said separated calcium from contact with said pulp fibers.

8. The according to claim 5, wherein said step of contacting said fibers with carbonic acid or a salt thereof in said aqueous environment has a pH lowering effect and an alkali is added to said aqueous environment to counter the pH lowering effect.

9. The method according to claim 8, wherein said alkali is sodium hydroxide.

10. The method of claim 1 or 4, wherein said step of contacting said fibers with carbonic acid or a salt thereof includes dissolving a salt of carbonic acid in said aqueous environment to provide carbonate and/or bicarbonate ions.

11. The method of claim 10, wherein said carbonate and/or bicarbonate ions are selected from the group consisting of sodium carbonate and sodium bicarbonate.

12. The method according to claim 1 or 4, wherein said aqueous environment is an aqueous pulp suspension or filtrate from a dewatering stage.

13. The method according to claim 1 or 4, wherein said aqueous environment is a chemical pulp.

14. The method according to claim 13, wherein said chemical pulp is an unbleached pulp before, after or in a wash stage of a fiber line of a pulp mill.

15. The method according to claim to 14, wherein said chemical pulp is an unbleached pulp just after a wash stage of a fiber line of a pulp mill.

16. The method according to claim 13, wherein said chemical pulp is a washed chemical pulp and carbon dioxide is fed into a stream of pulp between a wash stage and a storage at the end of a fiber line of a cellulose mill.

17. The method according to claim 13, wherein carbon dioxide is fed into a stream of water used to dilute the pulp just before or just after final storage of a fiber line.

18. The method according to claim 13, wherein said chemical pulp is a pulp that has been bleached in an oxygen delignification step.

19. The method according to claim 13, wherein said chemical pulp is a pulp that is to be bleached subsequently with chlorine dioxide, peroxide, peracetic acid, ozone, chlorine or hypo.

20. The method according to claim 19, wherein carbon dioxide is fed into a pulp added before or after a storage tower or to a dilution water added to said pulp before, in or after a storage tower preceding a chlorine dioxide bleaching stage in a fiber line of a cellulose mill.

21. The method according to claim 13, wherein said pulp is a papermaking stock before, after or in a stock preparation stage of a paper machine.

22. The method according to claim 21, wherein said stock preparation stage is a dilution stage, a refining stage, a screening stage or a mixing stage.

23. The method according to claim 1 or 4, wherein said aqueous environment is an unbleached or a semi-bleached pulp.

24. The method according to claim 1 or 4, wherein calcium is trapped by carbonate or bicarbonate ions provided by said carbonic acid or its salt thereby reducing the influence of calcium on said lignin and facilitating the bleaching of lignin and/or freeing of lignin from fibers in said pulp suspension.

* * * * *